US008353578B2

(12) United States Patent
Matsuura

(10) Patent No.: US 8,353,578 B2
(45) Date of Patent: Jan. 15, 2013

(54) PIEZOELECTRIC ACTUATOR AND LIQUID-DROPLET EJECTION HEAD

(75) Inventor: Kazunari Matsuura, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 152 days.

(21) Appl. No.: 13/030,799

(22) Filed: Feb. 18, 2011

(65) Prior Publication Data

US 2011/0205309 A1 Aug. 25, 2011

(30) Foreign Application Priority Data

Feb. 19, 2010 (JP) ..... 2010-034996

(51) Int. Cl.
*B41J 2/045* (2006.01)
*B41J 2/14* (2006.01)
*B41J 2/16* (2006.01)

(52) U.S. Cl. ..... 347/68; 347/50; 347/71

(58) Field of Classification Search ..... 347/50, 347/68, 721
See application file for complete search history.

(56) References Cited

U.S. PATENT DOCUMENTS 7,530,676 B2 * 5/2009 Tomozawa et al. ..... 347/71
2008/0211883 A1 9/2008 Yamashita et al.

FOREIGN PATENT DOCUMENTS

JP 2007-021854 A 2/2007
JP 2008-195047 A 8/2008

* cited by examiner

*Primary Examiner* — Matthew Luu
*Assistant Examiner* — Lisa M Solomon
(74) *Attorney, Agent, or Firm* — Baker Botts L.L.P.

(57) ABSTRACT

A piezoelectric actuator disposed on a surface of a flow-path forming member may comprise a first piezoelectric layer disposed farthest from the surface of the flow-path forming member. The piezoelectric actuator may comprise a surface electrode disposed on one surface of the first piezoelectric layer opposite the surface of the flow-path forming member. The piezoelectric actuator may comprise a land bonded to a terminal of a power supply member. The piezoelectric actuator may comprise a continuous detection electrode including an outer peripheral portion extending along the outline of an area that opposes the land to surround the area and being disposed on one of the other surface of the first piezoelectric layer and a surface of a second piezoelectric layer.

16 Claims, 7 Drawing Sheets

PIEZOELECTRIC ACTUATOR AND LIQUID-DROPLET EJECTION HEAD

CROSS REFERENCE TO RELATED APPLICATION

This application claims priority to Japanese Patent Application NO. 2010-034996, filed Feb. 19, 2010, the entire subject matter and disclosure of which is incorporated herein by reference.

BACKGROUND OF THE DISCLOSURE

1. Field of the Disclosure

The features described herein relate generally to a piezoelectric actuator disposed on a surface of a flow-path forming member of a liquid-droplet ejection head to apply energy to liquid in pressure chambers disposed in the surface, and also relate generally to a liquid-droplet ejection head having the piezoelectric actuator.

2. Description of Related Art

A known liquid-droplet ejection head may include a piezoelectric actuator disposed on a surface of a flow-path forming member (cavity unit). The piezoelectric actuator may be driven to apply energy to ink in pressure chambers disposed in the surface. Ink droplets are ejected from ejection ports of nozzles communicating with the pressure chambers. The piezoelectric actuator include piezoelectric layers (ceramic layers) and electrodes disposed on both surfaces of the piezoelectric layers so as to sandwich the piezoelectric layers in the thickness direction.

A crack may be generated in piezoelectric layers in the process of manufacturing piezoelectric actuators. The crack may be generated in the process of mounting the piezoelectric actuators to flow-path forming members. The crack may be generated in the process of bonding flexible printed circuits (FPCs) to the piezoelectric actuators. The crack generated in the piezoelectric layers may allow ink in the pressure chambers to flow into the crack, causing an electrical short-circuit. The known liquid droplet ejection head include a crack-detecting electrode, which is disposed on the piezoelectric layer positioned at the bottom of the piezoelectric layers included in the piezoelectric actuator. The crack detecting electrode is configured to detect a crack by allowing a current to flow through the crack-detecting electrode.

SUMMARY OF THE DISCLOSURE

When lands electrically connected to terminals of an FPC are disposed on the piezoelectric layers, a crack tends to be generated in the areas that oppose the lands in the piezoelectric layers. Because the lands are subjected to a large force in the process of bonding the FPC to the piezoelectric actuator. The crack generated in such an area may cause migration.

According to one embodiment described herein, a piezoelectric actuator disposed on a surface of a flow-path forming member of a liquid-droplet ejection head, the piezoelectric actuator applying energy to liquid in pressure chambers that are opened in the surface, the piezoelectric actuator may comprise a first piezoelectric layer disposed farthest from the surface of the flow-path forming member among one or more piezoelectric layers included in the piezoelectric actuator, the first piezoelectric layer having a first active portion that is displaced by an electric field acting in a thickness direction. The piezoelectric actuator may comprise a surface electrode configured to apply an electric field to the first active portion, the surface electrode being disposed on one surface of the first piezoelectric layer opposite the surface of the flow-path forming member. The piezoelectric actuator may comprise a land bonded to a terminal of a power supply member configured to supply a signal to the surface electrode, the land being disposed so as to be electrically connected to the surface electrode on the one surface of the first piezoelectric layer. The piezoelectric actuator may comprise a continuous detection electrode including an outer peripheral portion extending along the outline of an area that opposes the land so as to surround the area, the detection electrode being disposed on one of the other surface of the first piezoelectric layer and a surface of a second piezoelectric layer underlying the first piezoelectric layer.

According to another embodiment described herein, a liquid-droplet ejection head may comprise a flow-path forming member including an ejection surface in which ejection ports for ejecting droplets are opened and a surface in which pressure chambers connected to the ejection ports are opened, and a piezoelectric actuator disposed on the surface of the flow-path forming member and configured to apply energy to liquid in the pressure chambers. The piezoelectric actuator may comprise a first piezoelectric layer disposed farthest from the surface of the flow-path forming member among one or more piezoelectric layers included in the piezoelectric actuator, the first piezoelectric layer having a first active portion that is displaced by an electric field acting in a thickness direction. The piezoelectric actuator may comprise a surface electrode configured to apply an electric field to the first active portion, the surface electrode being disposed on one surface of the first piezoelectric layer opposite the surface of the flow-path forming member. The piezoelectric actuator may comprise a land bonded to a terminal of a power supply member configured to supply a signal to the surface electrode, the land being disposed so as to be electrically connected to the surface electrode on the one surface of the first piezoelectric layer. The piezoelectric actuator may comprise a continuous detection electrode including an outer peripheral portion extending along the outline of an area that opposes the land so as to surround the area, the detection electrode being disposed on one of the other surface of the first piezoelectric layer and a surface of a second piezoelectric layer underlying the first piezoelectric layer.

Other objects, features and advantages will be apparent to persons of ordinary skill in the art from the following description with reference to the accompanying drawings.

BRIEF DESCRIPTION OF THE DRAWINGS

Embodiments of a printing apparatus and a printing method are described with reference to the accompanying drawings, which are given by way of example only, and are not intended to limit the present patent.

DESCRIPTION OF THE EMBODIMENTS

Various embodiments, and their features and advantages, may be understood by referring to FIGS. 1-7, like numerals being used for corresponding parts in the various drawings.

Figure 1:
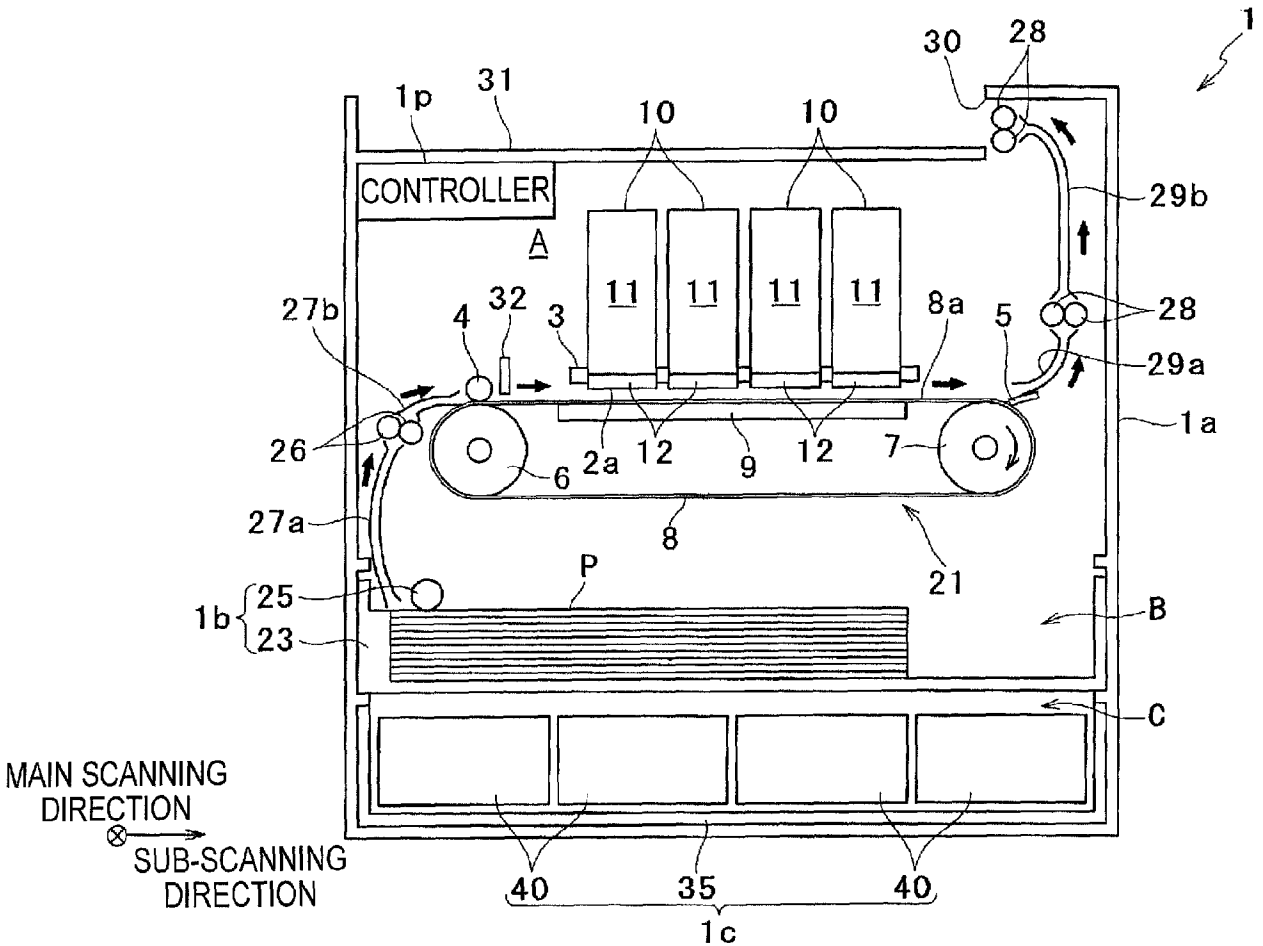
FIG. 1 is a schematic side view showing the inner structure of an ink jet printer including ink jet heads, according to an embodiment.

Referring to FIG. 1, the overall structure of an ink jet printer 1 having ink jet heads 10, according to an embodiment will be described. Herein, each head 10 is an embodiment of a liquid-droplet ejection head and includes actuator units 17 (see FIG. 2), which are an embodiment of a piezoelectric actuator.

The printer 1 includes a rectangular-parallelepiped-shaped casing 1*a*. A sheet-output portion 31 is disposed on the top plate of the casing 1*a*. The inner space of the casing 1*a* may be divided into spaces A, B, and C, in sequence from above. In the spaces A and B, a sheet-conveying path continuous with the sheet-output portion 31 is formed. In the space A, the conveyance of a sheet P and image formation on the sheet P are performed. In the space B, a sheet-feed operation is performed. The space C accommodates ink cartridges 40, which function as ink supply sources.

The space A accommodates a plurality of, e.g., four, heads 10, a conveying unit 21 for conveying the sheet P, a guide unit for guiding the sheet P, etc. A controller 1*p*, which controls operations of the respective sections of the printer 1, including the aforementioned mechanisms, and the operation of the entire printer 1, is disposed at the top of the space A.

The controller 1*p* include a read only memory (ROM), a random access memory (RAM) (including non-volatile RAM), an application specific integrated circuit (ASIC), an interface (I/F), an input/output port (I/O), etc., in addition to a central processing unit (CPU) functioning as an arithmetic processing unit. The ROM stores programs executed by the CPU, various fixed data, etc. The RAM temporarily stores data necessary to execute the programs (for example, image data). The ASIC rewrites and sorts the image data (signal processing and image processing). The I/F sends the data to or receives the data from higher-level devices. Detection signals of various sensors are inputted or outputted through the I/O. The controller 1*p* controls the respective sections of the printer 1 in cooperation with the above-described hardware configuration and the programs stored in the ROM, such that a preparation operation for image formation; feeding, conveyance, and output operations of the sheet P; an ink ejection operation synchronized with the conveyance of the sheet P; and the like may be performed.

The heads 10 have a substantially rectangular-parallelepiped-shape. The heads 10 are line head that is long in the main scanning direction. The plurality of, e.g., four heads 10 are arranged at a predetermined interval in the sub-scanning direction and are supported by the casing 1*a* through a head frame 3. Each head 10 includes a flow path unit 12, a plurality of, e.g., eight, actuator units 17 (see FIG. 2), and a reservoir unit 11. During image formation, magenta, cyan, yellow, and black ink droplets are ejected from the bottom surface of the head 10 (an ejection surface 2*a*).

Referring to FIG. 1, the conveying unit 21 includes belt rollers 6 and 7, an endless conveying belt 8 that is wound around and runs between the belt rollers 6 and 7, a nip roller 4 and a separation plate 5 disposed outside the conveying belt 8, a platen 9 disposed inside the conveying belt 8, etc.

The belt roller 7 functioning as a driving roller is rotated clockwise in FIG. 1 by a conveying motor (not shown). The rotation of the belt roller 7 causes the conveying belt 8 to move in the direction indicated by bold arrows in FIG. 1. The belt roller 6 functioning as a driven roller is rotated clockwise in FIG. 1, in accordance with the movement of the conveying belt 8. The nip roller 4 is disposed so as to oppose the belt roller 6 to press the sheet P fed from an upstream guide portion onto an outer peripheral surface 8*a* of the conveying belt 8. The separation plate 5 is disposed so as to oppose the belt roller 7 to guide the sheet P separated from the outer peripheral surface 8*a* toward a downstream guide portion. The platen 9 is disposed so as to oppose the plurality of, e.g., four heads 10 to support the upper loop portion of the conveying belt 8 from inside. Thus, a predetermined gap suitable for image formation is formed between the outer peripheral surface 8*a* and the ejection surfaces 2*a* of the heads 10.

The guide unit includes the upstream guide portion and the downstream guide portion that are disposed with the conveying unit 21 therebetween. The upstream guide portion includes a plurality of, e.g., two, guides 27*a* and 27*b*, and a pair of feed rollers 26. This guide portion connects a sheet-feed unit 1*b* and the conveying unit 21. The downstream guide portion includes a plurality of, e.g., two, guides 29*a* and 29*b*, and a plurality of, e.g., two, pairs of feed rollers 28. This guide portion connects the conveying unit 21 and the sheet-output portion 31.

The sheet-feed unit 1*b* is disposed in the space B, such that it is attached to or removed from the casing 1*a*. The sheet-feed unit 1*b* includes a sheet-feed tray 23 and a sheet-feed roller 25. The sheet-feed tray 23 is an open-top box and store a plurality of sizes of the sheet P. The sheet-feed roller 25 feeds the sheet P at the top in the sheet-feed tray 23 to the upstream guide portion.

The sheet-conveying path extending from the sheet-feed unit 1*b* via the conveying unit 21 to the sheet-output portion 31 is formed in the spaces A and B. The controller 1*p* drives a sheet-feed motor (not shown) for the sheet-feed roller 25, feed motors (not shown) for feed rollers of the respective guide portions, conveying motors, etc., in accordance with the recording instruction. The sheet P fed from the sheet-feed tray 23 is fed to the conveying unit 21 by the feed roller 26. When the sheet P passes immediately below the heads 10 in the sub-scanning direction, the ink droplets are ejected from the ejection surfaces 2*a*, forming a color image on the sheet P. The ink droplets are ejected according to a detection signal from the sheet sensor 32. Then, the sheet P is separated by the separation plate 5 and is conveyed upward by the plurality of, e.g., two, pairs of feed rollers 28. Then, the sheet P is discharged onto the sheet-output portion 31 through an opening 30 formed at the top.

Herein, the "sub-scanning direction" is the direction parallel to the direction in which the sheet P is conveyed by the conveying unit 21, and the "main scanning direction" is the direction parallel to the horizontal plane and perpendicular to the sub-scanning direction.

An ink unit 1*c* is disposed in the space C, such that it is attached to or removed from the casing 1*a*. The ink unit 1*c* includes a cartridge tray 35 and a plurality of, e.g., four, cartridges 40 stored side-by-side in the tray 35. Each cartridge 40 supplies ink to the corresponding head 10 through an ink tube (not shown).

Figure 2:
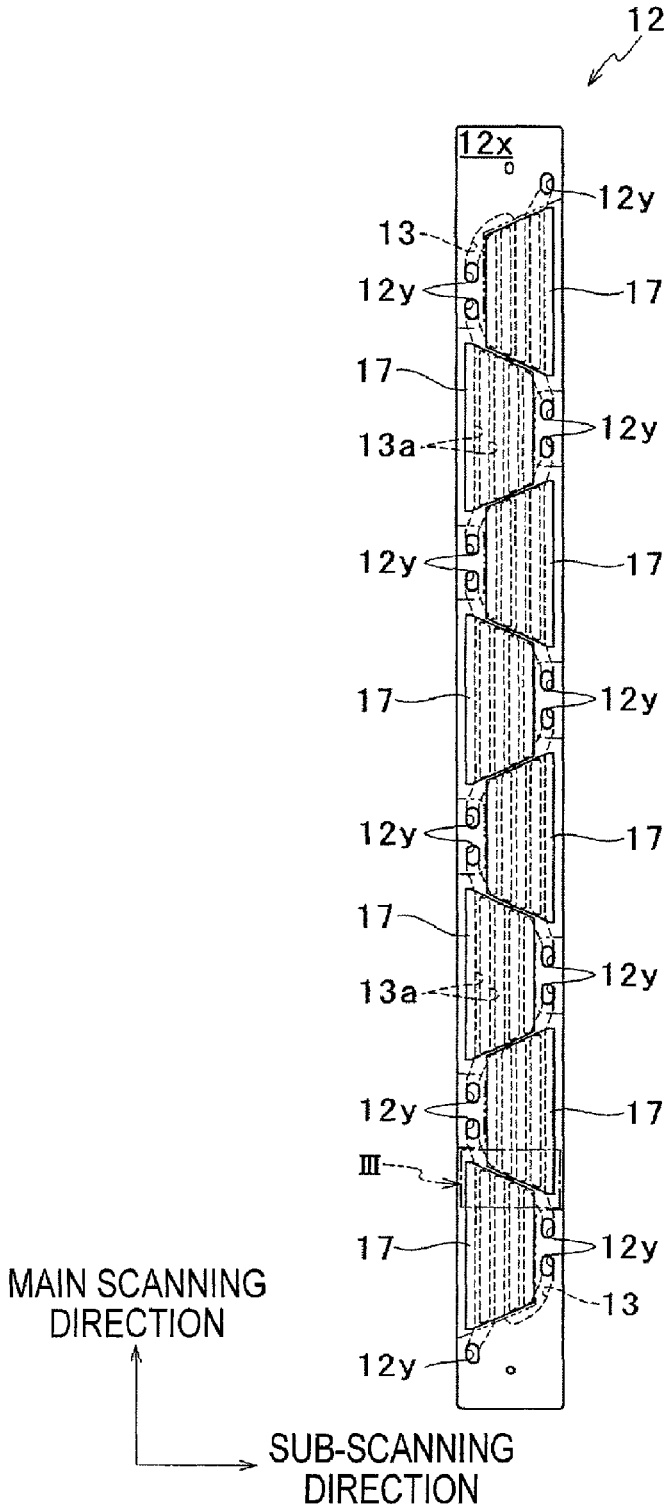
FIG. 2 is a plan view showing a flow path unit and actuator units of the ink jet head.
Figure 3:
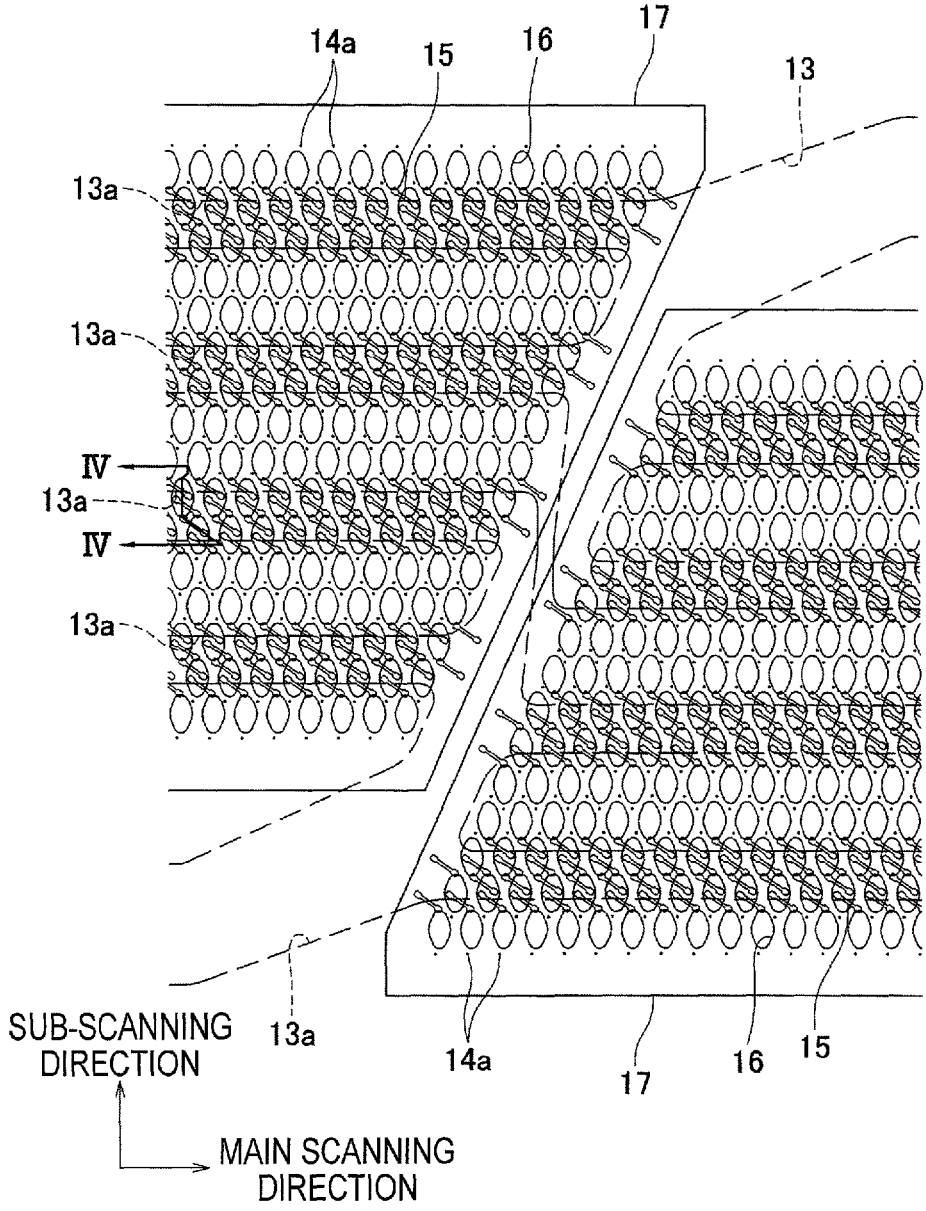
FIG. 3 is an enlarged view showing area III surrounded by one-dot chain line in FIG. 2.

Referring to FIGS. 2 to 5, the configuration of the head 10 will be described in more detail. In FIG. 3, pressure chambers 16 and apertures 15 located below the actuator units 17 are illustrated by solid line.

Figure 5:
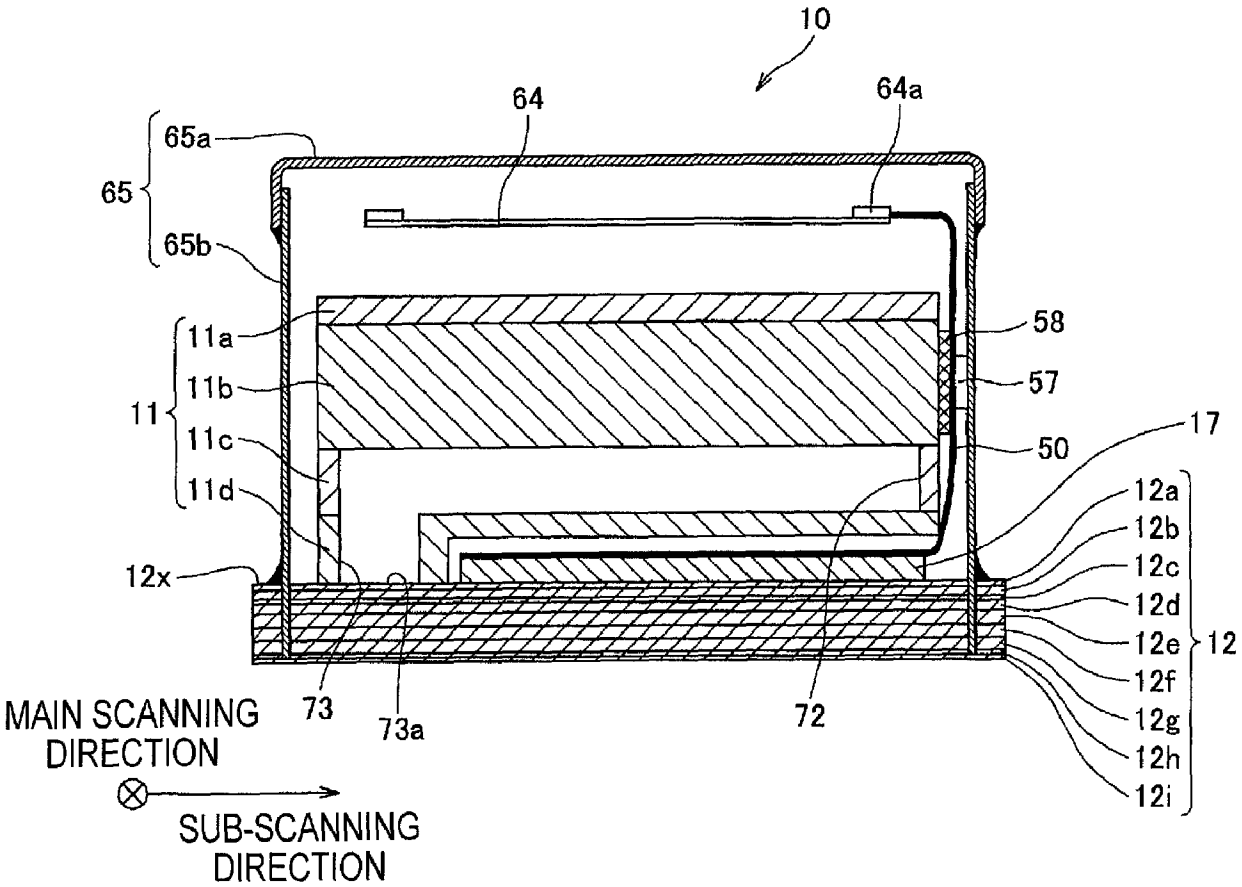
FIG. 5 is a longitudinal cross-section of the ink jet head.

Referring to FIG. 5, the head 10 is a stacked body configured by stacking the flow path unit 12, the actuator units 17, the reservoir unit 11, and a substrate 64. The actuator units 17, the reservoir unit 11, and the substrate 64 are accommodated in a space defined by a top surface 12*x* of the flow path unit 12 and a cover 65. In this space, an FPC 50 electrically connects the actuator units 17 and the substrate 64. A driver IC 57 is mounted on the FPC 50.

The cover 65 includes a top cover 65*a* and a side cover 65*b*. The cover 65 is a box that is opened at the bottom and is secured to the top surface 12*x* of the flow path unit 12. The boundary between the covers 65*a* and 65*b*, as well as the boundary between the side cover 65*b* and the top surface 12*x*, is sealed with a silicon agent. The side cover 65*b* is made of an aluminum plate and also functions as a heat-radiating plate. The driver IC 57 is in contact with and thermally coupled to the side cover 65*b*. The driver IC 57 is urged against the side cover 65*b* by an elastic member (for example, a sponge) 58 secured to the side surface of the reservoir unit 11 so as to ensure this thermal coupling.

The reservoir unit 11 is a stacked body configured by bonding a plurality of, e.g., four, metal plates 11*a* to 11*d* having through-holes and recesses. An ink flow path is formed in the reservoir unit 11. A reservoir 72, in which ink is temporarily reserved, is formed in the plate 11*c*. One end of the ink flow path is connected to the corresponding cartridge 40 through a tube or the like, and the other end of the ink flow path is opened in the bottom surface of the reservoir unit 11. The bottom surface of the plate 11*d* has a recess and a projection, and the recess provides a space between the plate 11*d* and the top surface 12*x*. The actuator units 17 are secured to the top surface 12*x* in this space. A slight gap is formed between the recess in the bottom surface of the plate 11*d* and the FPC 50 on the actuator units 17. The plate 11*d* has an ink outflow path 73 (part of the ink flow path of the reservoir unit 11) that communicates with the reservoir 72. This flow path 73 is opened in an end surface of the projection on the bottom surface of the plate 11*d* (that is, the surface to be bonded to the top surface 12*x*).

Figure 4:
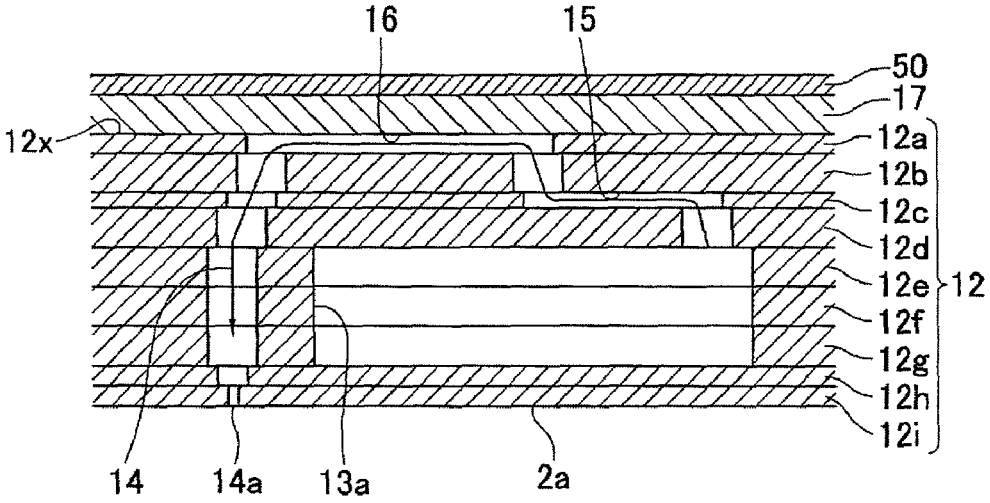
FIG. 4 is a partial sectional view taken along line IV-IV in FIG. 3.

The flow path unit 12 is a stacked body formed by bonding a plurality of, e.g., nine, rectangular metal plates 12*a*, 12*b*, 12*c*, 12*d*, 12*e*, 12*f*, 12*g*, 12*h*, and 12*i* having substantially the same size (see FIG. 4). Referring to FIG. 2, the top surface 12*x* of the flow path unit 12 has openings 12*y* opposite openings 73*a* of the ink outflow path 73. Ink flow paths extending from the openings 12*y* to the ejection ports 14*a* are formed in the flow path unit 12. Referring to FIGS. 2, 3, and 4, the ink flow paths each include a manifold flow path 13 having the opening 12*y* at one end, a sub-manifold flow path 13*a* diverged from the manifold flow path 13, and an individual ink flow path 14 extending from the exit of the sub-manifold flow path 13*a* through the pressure chamber 16 to the ejection port 14*a*. Referring to FIG. 4, the individual ink flow path 14 is formed for each ejection port 14*a* and includes an aperture 15 functioning as a flow-path-resistance-regulating throttle. A plurality of pressure chambers 16 are opened in the top surface 12*x*. The openings of the pressure chambers 16 are each substantially diamond-shaped and constitute a plurality of, e.g., eight, pressure chamber groups in total, each having substantially a trapezoidal area in plan view, by being arranged in a matrix form. Similarly to the pressure chambers 16, the ejection ports 14*a* that are opened in the ejection surface 2*a* also constitute a plurality of, e.g., eight, ejection port groups, each having substantially a trapezoidal area in plan view, by being arranged in a matrix form.

Referring to FIG. 2, the actuator units 17, each having a trapezoidal shape in plan view, are disposed on the top surface 12*x* of the flow path unit 12 in a plurality of, e.g., two, lines in a staggered manner. Furthermore, referring to FIG. 3, the actuator units 17 are disposed on the trapezoidal areas occupied by the pressure chamber groups (the ejection port groups). The actuator units 17 are disposed such that the base portions of the trapezoid are located near the ends of the flow path unit 12 in the sub-scanning direction. The actuator units 17 are disposed so as to avoid the projections on the bottom surface of the reservoir unit, and the base portions of the trapezoid are located between the openings 12*y* (openings 73*a*) in the main scanning direction.

The FPC 50 is provided for each actuator unit 17, and a wire corresponding to each electrode of the actuator unit 17 is connected to the output terminal of the driver IC 57. The FPC 50, under the control of the controller 1*p* (see FIG. 1), transmits various driving signals adjusted by the substrate 64 to the driver IC 57 and transmits the driving voltages generated by the driver IC 57 to the actuator units 17. The driving voltages are selectively applied to the electrodes of the actuator units 17.

Referring to FIGS. 6A to 6C and 7, the configuration of the actuator units 17 will be described.

Figure 6A:
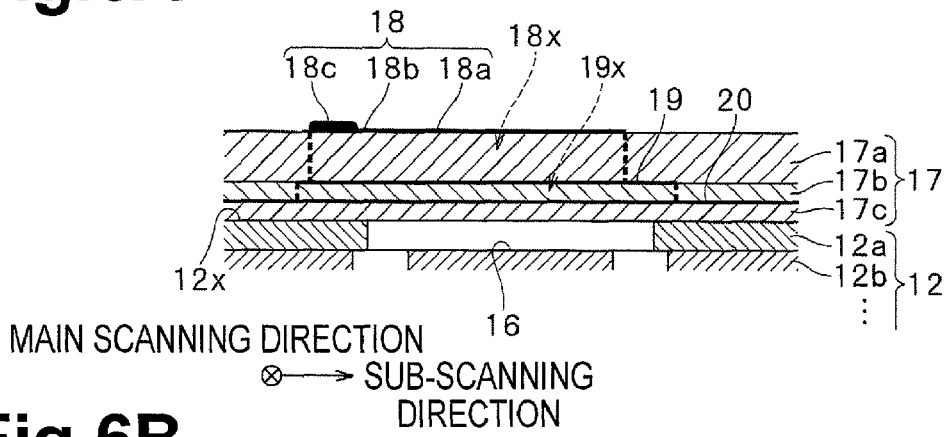
FIG. 6A is a partial sectional view showing the actuator unit.

Referring to FIG. 6A, the actuator units 17 each include a stacked body configured of a plurality of, e.g., two, piezoelectric layers 17*a* and 17*b*, and a diaphragm 17*c* disposed between the stacked body and the flow path unit 12. The piezoelectric layers 17*a*, 17*b*, and the diaphragm 17*c* are sheet-like members made of a ferroelectric lead zirconate titanate (PZT) ceramic material. The piezoelectric layers 17*a*, 17*b*, and the diaphragm 17*c* have substantially the same size and shape (trapezoidal shape) as viewed from the thickness direction of the piezoelectric layers 17*a* and 17*b*. The diaphragm 17*c* blocks the openings of the pressure chamber groups (multiple pressure chambers 16) disposed in the top surface 12*x* of the flow path unit 12. The thickness of the outermost piezoelectric layer 17*a* is larger than the total thickness of the piezoelectric layer 17*b* and the diaphragm 17*c*. The piezoelectric layers 17*a* and 17*b* are polarized in the same direction along the thickness direction.

Multiple independent electrodes 18 corresponding to the pressure chambers 16 are disposed on the top surface of the piezoelectric layer 17*a*, an inner electrode 19 is disposed between the piezoelectric layer 17*a* and the underlying piezoelectric layer 17*b*, and a common electrode 20 is disposed between the piezoelectric layer 17*b* and the underlying diaphragm 17*c*. There is no electrode disposed on the bottom surface of the diaphragm 17*c*.

Figure 6B:
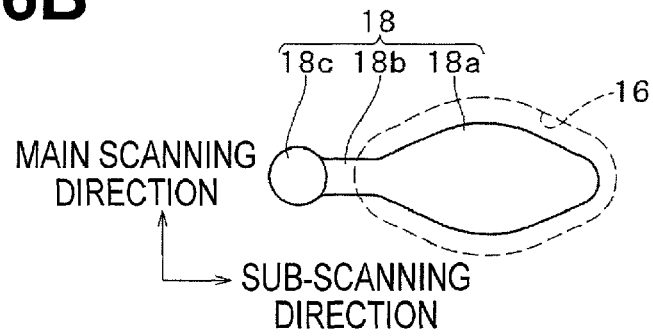
FIG. 6B is a plan view showing an independent electrode included in the actuator unit.

The independent electrodes 18 are disposed independently for the pressure chambers 16 and are arranged in a matrix form so as to form a plurality of lines and columns, similarly to the pressure chambers 16. Referring to FIG. 6B, each independent electrode 18 includes a surface electrode 18*a*, an extraction electrode 18*b* extracted from one of apex portions of the surface electrode 18*a*, and a land 18*c* disposed on the extraction electrode 18*b*. The shape of the surface electrode 18*a* is analogous to that of the opening of the pressure chamber 16, and the size thereof is smaller than that of the opening of the pressure chamber 16. In plan view, the surface electrode 18*a* is disposed in the opening of the pressure chamber 16. The extraction electrode 18*b* is extracted to the outer side of the opening of the pressure chamber 16, and the land 18*c* is disposed at the end thereof. The land 18*c* is electrically connected to the surface electrode 18*a* through the extraction electrode 18*b*. The land 18*c* is circular in plan view and does not oppose the pressure chamber 16. The land 18*c* has a height of about 50 μm from the top surface of the piezoelectric layer 17*a* and is electrically connected to the terminal of the wire of the FPC 50. The piezoelectric layer 17*a* and the FPC 50 are opposed to each other with a gap of substantially 50 μm therebetween, at a portion other than the above-mentioned connected portion. This ensures free deformation of the actuator units 17.

Figure 6C:
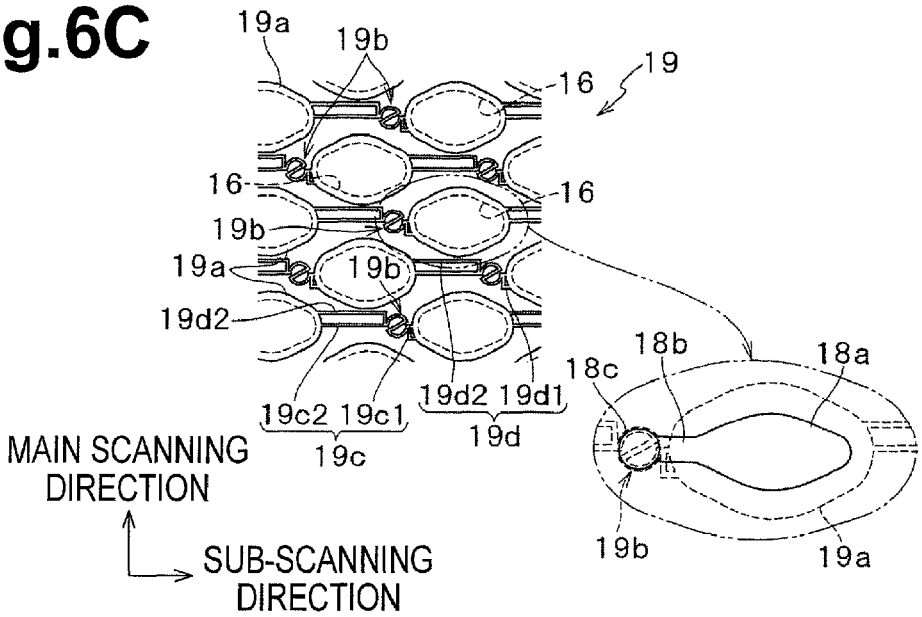
FIG. 6C is a plan view showing an inner electrode included in the actuator unit.

Referring to FIG. 6C, the inner electrode 19 includes multiple individual electrodes 19*a* provided for the respective pressure chambers 16, multiple detection electrodes 19*b* provided for the respective lands 18*c*, multiple extension electrodes 19*c* connecting the individual electrodes 19*a* and the detection electrodes 19*b* adjacent to each other in the sub-scanning direction, and auxiliary electrodes 19*d* disposed in parallel with the extension electrodes 19*c*. In one actuator unit 17, the electrodes 19*a*, 19*b*, 19*c*, and 19*d* included in the inner electrode 19 are all electrically connected and are kept at the same potential. Between two ends (both ends) of the inner electrode 19, all the individual electrodes 19*a* and the detection electrodes 19*b* are alternately connected in series to each other through pairs of the extension electrode 19*c* and auxiliary electrode 19*d*.

The individual electrodes 19*a* relate to meniscus vibration. The individual electrodes 19*a* are analogous to and larger than the openings of the pressure chambers 16, as viewed from the thickness direction of the piezoelectric layers 17*a* and 17*b*. Referring to FIG. 6C, the individual electrodes 19*a* contain the openings of the pressure chambers 16 in plan view.

Figure 7:
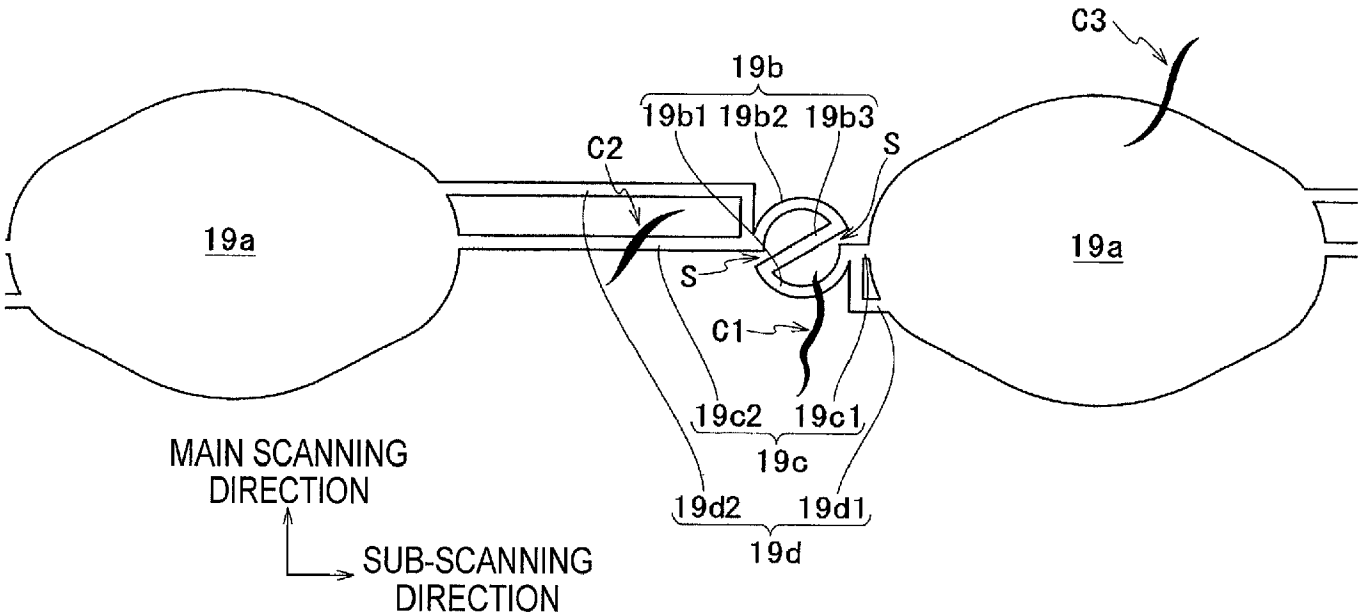
FIG. 7 is a partial enlarged view of the inner electrode.

The detection electrodes 19*b* are continuous electrodes. Each detection electrode 19*b* has a conductive wire pattern having two ends that are connected to each other without crossing or overlapping. Referring to FIG. 7, the detection electrode 19*b* has a substantially Z shape and includes a first outer peripheral portion 19*b*1, a second outer peripheral portion 19*b*2, and a central portion 19*b*3. The outer peripheral portion including the first and second outer peripheral portions 19*b*1 and 19*b*2 extends along the outline of the circular area that opposes the land 18*c* so as to surround this area, as shown in the partial enlarged view encircled by two-dot chain line in FIG. 6C (in this enlarged view, the components of the inner electrode 19 are illustrated by dotted line, and the components of the independent electrode 18 are illustrated by solid line). The first and second outer peripheral portions 19*b*1 and 19*b*2 extend along the outline of substantially the half of the circular area that opposes the land 18*c*. Because the detection electrode 19*b* is continuous, the length of the outer peripheral portions 19*b*1 and 19*b*2 is slightly smaller than that of the half of the outer periphery of the land 18*c*, and there are gaps S between the ends of the outer peripheral portions 19*b*1 and 19*b*2 opposite each other. The linear central portion 19*b*3 passes through the center of the circular area that opposes the land 18*c* and electrically connects the ends of the first and second outer peripheral portions 19*b*1 and 19*b*2 to each other.

The extension electrodes 19*c* connect the detection electrodes 19*b* and the individual electrodes 19*a* in the sub-scanning direction. Each extension electrode 19*c* includes a plurality of, e.g., two, linear electrodes (a first extension electrode 19*c*1 and a second extension electrode 19*c*2) that have different lengths. The first and second extension electrodes 19*c*1 and 19*c*2 extend from the ends of the first and second outer peripheral portions 19*b*1 and 19*b*2, respectively, toward the outer side of the circular area that opposes the land 18*c*. The first extension electrode 19*c*1 electrically connects the other end of the first outer peripheral portion 19*b*1, which is the end opposite the end connected to the central portion 19*b*3, to the individual electrode 19*a* that is closer to the detection electrode 19*b* in the sub-scanning direction. The surface electrode 18*a* that opposes this individual electrode 19*a* is connected to the land 18*c* that opposes this first extension electrode 19*c*1. The second extension electrode 19*c*2 electrically connects the other end of the second outer peripheral portion 19*b*2, which is the end opposite the end connected to the central portion 19*b*3, to the individual electrode 19*a* that is farther from the detection electrode 19*b* in the sub-scanning direction. The surface electrode 18*a* that opposes this individual electrode 19*a* is not connected to the land 18*c* that opposes this second extension electrode 19*c*2 and is isolated. One detection electrode 19*b* is disposed between two individual electrodes 19*a* in the sub-scanning direction. Herein, referring to FIG. 7, the first extension electrode 19*c*1 is shorter than the second extension electrode 19*c*2. The positions of the first and second extension electrodes 19*c*1 and 19*c*2 are the same in the main scanning direction.

The auxiliary electrodes 19*d* connect the detection electrodes 19*b* and the individual electrodes 19*a* in the sub-scanning direction, similarly to the extension electrodes 19*c*. Each auxiliary electrode 19*d* includes two L-shaped electrodes (a first auxiliary electrode 19*d*1 and a second auxiliary electrode 19*d*2) that have different lengths. The first and second auxiliary electrodes 19*d*1 and 19*d*2 extend from the other ends of the first and second outer peripheral portions 19*b*1 and 19*b*2, respectively, in opposite directions along the main scanning direction and then turn and extend in opposite directions along the sub-scanning direction. The first auxiliary electrode 19*d*1 electrically connects the other end of the first outer peripheral portion 19*b*1 and the individual electrode 19*a* that is connected to this other end through the first extension electrode 19*c*1. The second auxiliary electrode 19*d*2 electrically connects the other end of the second outer peripheral portion 19*b*2 and the individual electrode 19*a* that is connected to this other end through the second extension electrode 19*c*2.

The extension electrode 19*c* and the auxiliary electrode 19*d* are disposed in parallel in the main scanning direction. Referring to FIG. 7, the first auxiliary electrode 19*d*1 and the first extension electrode 19*c*1, as well as the second auxiliary electrode 19*d*2 and the second extension electrode 19*c*2, are disposed in parallel so as to oppose each other in the main scanning direction. The first extension electrode 19*c*1 and the first auxiliary electrode 19*d*1 diverge from each other at the other end of the first outer peripheral portion 19*b*1, and the second extension electrode 19*c*2 and the second auxiliary electrode 19*d*2 diverge from each other at the other end of the second outer peripheral portion 19*b*1.

The positions at which the first and second auxiliary electrodes 19*d*1 and 19*d*2 are connected to the individual electrodes 19*a* are different from the positions at which the first and second extension electrodes 19*c*1 and 19*c*2 are connected to the individual electrodes 19*a*. The first and second extension electrodes 19*c*1 and 19*c*2 are connected to the individual electrodes 19*a* at apex portions, whereas the first and second auxiliary electrodes 19*d*1 and 19*d*2 are connected to the individual electrodes 19*a* at positions slightly shifted from the apex portions in the main scanning direction. The first and second auxiliary electrodes 19*d*1 and 19*d*2 are shifted from the apex portions by the same amount.

The common electrode 20 is common to all the pressure chambers 16 in one actuator unit 17 and is disposed over the entire surfaces of the diaphragm 17*c* and the piezoelectric layer 17*b*. This prevents the electric fields generated in the piezoelectric layers 17*a* and 17*b* from acting on the pressure chambers 16. The common electrode 20 is constantly maintained at the ground potential.

Lands for the inner electrode (not shown) and lands for the common electrode (not shown) are disposed on the top surface of the piezoelectric layer 17*a*, in addition to the lands 18*c* for the independent electrode. On the top surface, the lands 18*c* for the independent electrode occupy a trapezoidal area analogous to the top surface at the central portion. Each land for the common electrode is disposed near each of the four corners of the trapezoid on the top surface. Each land for the inner electrode is disposed substantially at the middle of each of the oblique sides on the top surface. The lands for the inner electrode are electrically connected to the inner electrode 19 through through-holes in the piezoelectric layer 17*a*, and the lands for the common electrode are electrically connected to the common electrode 20 through through-holes penetrating through the piezoelectric layers 17*a* and 17*b*. The lands are connected to the terminals of the FPC 50. The lands for the common electrode are connected to the grounded wires, and the lands for the inner electrode are connected to the wires extending from the output terminals of the driver IC 57.

Portions sandwiched between the electrodes 18, 19, and 20 in the piezoelectric layers 17*a* and 17*b* function as active portions. Independent active portions 18*x* sandwiched between the electrodes 18 and 19 in the thickness direction are disposed in the piezoelectric layer 17*a*, and inner active portions 19*x* sandwiched between the electrodes 19 and 20 in the thickness direction are disposed in the piezoelectric layer 17*b*. In the actuator units 17, pairs of the vertically stacked active portions 18*x* and 19*x* are disposed so as to oppose the openings of the pressure chambers 16, and the energy is applied to the ink in the pressure chambers 16 by the displacement of the two active portions 18*x* and 19*x*. The pairs of the vertically stacked active portions 18*x* and 19*x* (that are disposed so as to oppose each other in the thickness direction) are capable of deformation with respect to the respective pressure chambers 16, independently. That is, the actuator units 17 include piezoelectric actuators provided for the respective pressure chambers 16. The active portions 18*x* and 19*x* may be displaced in at least one of d31, d33, and d15 vibration modes.

Electric fields are applied to the independent active portions 18*x* by a potential difference between the surface electrodes 18*a* and the inner electrode 19, and electric fields are applied to the inner active portions 19*x* by a potential difference between the inner electrode 19 and the common electrode 20. Once an electric field is applied in the same direction as the polarization direction, the active portions 18*x* and 19*x* contract in the surface direction due to the transversal piezoelectric effect. In contrast, a portion of the diaphragm 17*c* that opposes the active portions 18*x* and 19*x* in the thickness direction (a non-active portion) does not spontaneously deform upon application of an electric field. At this time, because a strain difference is generated between the diaphragm 17*c* and the piezoelectric layers 17*a* and 17*b*, or between the piezoelectric layers 17*a* and 17*b* and the diaphragm 17*c* when electric fields are selectively applied to the active portions 18*x* and 19*x*, the actuators are deformed so as to protrude toward the pressure chambers 16. The piezoelectric actuators of this configuration are of unimorph type.

The actuator units 17 may be driven by, for example, a so-called "pull-ejection method" in which the active portions 18*x* and 19*x* are displaced in $d_{31}$ vibration mode, and ink is supplied before ink droplets are ejected corresponding to one ejection-driving-voltage pulse, and a so-called "push-ejection method" in which the active portions 18*x* and 19*x* are displaced in $d_{33}$ vibration mode, and ink is not supplied before ink droplets are ejected corresponding to one ejection-driving-voltage pulse. More specifically, in the "pull-ejection method", the actuators are held in a deformed state so as to protrude toward the pressure chambers 16, and then the actuators are released when a driving voltage for image formation is applied. This increases the volume of the pressure chambers 16, causing ink to be supplied from the sub-manifold flow path 13*a* to the pressure chambers 16. Then, when the ink to be supplied reaches the pressure chambers 16, the actuators are deformed so as to protrude toward the pressure chambers 16. This decreases the volume of the pressure chambers 16, increasing the pressure applied to the ink in the pressure chambers 16. Thus, the ink in the form of ink droplets is ejected from the ejection ports 14*a*. In the "push-ejection method", the actuators are held flat, and then the actuators are deformed so as to protrude toward the pressure chambers 16 when a driving voltage for image formation is applied, thereby causing ink droplets to be ejected from the ejection ports 14*a*.

During image formation, a driving voltage is applied to the independent electrodes 18 according to the image data. The driving voltage contains a plurality of ejection voltage pulses. A vibration voltage for generating meniscus vibration is applied to the inner electrode 19. The vibration voltage contains a plurality of vibration voltage pulses. In one recording cycle, after a predetermined period of time has elapsed since the final ejection of ink droplets was performed, a predetermined number of voltage pulses for generating meniscus vibration are applied to the lands for the inner electrode. While the ejection voltage pulses are applied, the lands for the inner electrode are maintained at the ground potential. While the voltage pulses for generating meniscus vibration are applied, the potentials of the independent electrodes 18 and inner electrode 19 are maintained at the same level. While image formation is not performed (for example, while non-ejection flushing is performed), the active portions 19*x* are driven. Thus, the active portions 18*x* and 19*x* serve different functions, more specifically, the active portions 18*x* function to eject ink droplets, and the active portions 19*x* function to generate meniscus vibration. Compared with the case where one active portion serves both functions, stable ejection performance of the active portion for ejecting ink droplets may be maintained for a long term.

Next, a method for manufacturing the heads 10 will be described.

First, the flow path unit 12 and the actuator units 17 are prepared in separate steps. The lands for the inner electrode and the lands for the common electrode are disposed on the top surface of each actuator unit 17, in addition to the lands 18*c* for the individual electrode. At this stage, a continuity test for checking the continuity between the lands for the inner electrode (a first inspection step) is performed to eliminate actuator units 17 that have cracks near the lands 18*c*. Cracks that reach the lands 18*c* cause electrical failures (for example, migration). In this embodiment, the detection electrodes 19*b* are disposed immediately below the lands 18*c*. Cracks responsible for the migration are likely to cut the inspection electrodes 19*b*.

Next, the flow path unit 12 and the actuator units 17 are bonded (a bonding step). First, an adhesive is applied to the top surface 12*x* of the flow path unit 12. The adhesive is heat-curable. After the adhesive is applied, the actuator units 17 are aligned with the pressure chamber groups on the top surface 12*x* and are placed thereon. After the actuator units 17 are placed, the stacked body is heated while applying pressure from above and below. Thus, the adhesive is cured, and the actuator units 17 are fixed to the top surface 12*x*. Then, the reservoir unit 11 is fixed to the top surface 12*x* with the adhesive. Thus, the flow path component of the head 10 is formed.

Furthermore, electrical components, including the FPC 50, and the cover 65 are mounted. Thus, the head 10 is completed.

Also in this bonding step, if a foreign matter is sandwiched between the flow path unit 12 and the actuator units 17, a crack may be generated in the vicinity of the land near the foreign matter due to the pressure applied when they are fixed together. Even without such a foreign matter, a locally applied large pressure may cause stress concentration, causing a crack near the land.

It is also possible to examine whether or not the inspection electrode 19*b* has been cut after the bonding step by applying a predetermined voltage between a plurality of, e.g., two, lands for the inner electrode (second inspection step). This step is performed to eliminate a head precursor having a crack. When a broken wire is detected at this stage, the steps subsequent to the bonding step are canceled. When a broken wire is not detected, the process proceeds to the next step. In this embodiment, even if there is a crack that cuts the extension electrode 19*c* (auxiliary electrode 19*d*), the conduction between the plurality of, e.g., two, lands for the inner electrode is ensured because there is the auxiliary electrode 19*d* (extension electrode 19*c*).

Thus, this embodiment enables precise detection of cracks in the areas that oppose the lands 18*c* to be performed before and after the fixing step. Accordingly, unnecessary discarding of the heads 10 or the head precursors may be eliminated.

As has been described above, in the actuator units 17 and the heads 10 according to this embodiment, when a crack is generated in the area that opposes the land 18*c* (for example, a crack C1 shown in FIG. 7) in the piezoelectric layer 17*a* or the piezoelectric layer 17*b* having the detection electrode 19*b* (sandwiching the detection electrode 19*b*), the detection electrode 19*b* is cut, which may be detected by allowing a current to pass through the detection electrode 19*b*. Thus, precise detection of cracks in the areas that oppose the lands 18*c* in the piezoelectric layers 17*a* and 17*b* becomes possible.

When a crack is detected in the areas that oppose the lands 18*c* after the actuator units 17 are mounted on the flow path unit 12, the whole head 10, including the flow path unit 12, has to be discarded. In contrast, this embodiment enables precise detection of cracks in the areas that oppose the lands 18*c*, before and after the actuator units 17 are mounted on the flow path unit 12. Accordingly, unnecessary discarding of the heads 10 may be eliminated.

Because the areas that oppose the lands 18*c* in the outermost piezoelectric layer 17*a* are located immediately below the lands 18*c*, cracks are likely to be generated. In this embodiment, because the detection electrodes 19*b* are disposed on the surface of the piezoelectric layer 17*a* at the flow path unit 12, precise detection of cracks in the piezoelectric layer 17*a*, in the areas that oppose the lands 18*c*, is possible, without microscopic observation.

Each actuator unit 17 includes the piezoelectric layer 17*b* and the diaphragm 17*c*, which sandwich the detection electrodes 19*b* relative to the piezoelectric layer 17*a* from the flow path unit 12 side. Thus, an electrical failure caused by the detection electrodes 19*b* being exposed to the pressure chambers 16 may be avoided.

The surface electrodes 18*a* and lands 18*c* corresponding to the respective pressure chambers 16 are disposed on the surface of the piezoelectric layer 17*a* disposed over the openings of the pressure chambers 16. In addition, the detection electrodes 19*b* are electrically connected to the corresponding lands 18*c*. This not only simplifies the wire structure and signal-supplying structure with respect to the detection electrodes 19*b*, but also enables efficient crack detection over a large area (i.e., the areas that oppose the lands 18*c*).

In one actuator unit 17, all the lands 18*c* disposed on the surface of the piezoelectric layer 17*a* are electrically connected to all the corresponding detection electrodes 19*b*. This not only further simplifies the wire structure and signal-supplying structure with respect to the detection electrodes 19*b*, but also enables more efficient crack detection over a large area.

The actuator units 17 may perform recording and flushing (including ejection flushing and non-ejection flushing) using not only the independent active portions 18*x*, but also the inner active portions 19*x*; or selectively using these active portions 18*x* and 19*x* (herein, the term "ejection flushing" means that the actuator units 17 are driven to eject ink droplets from the ejection ports 14*a* and discharge thickened ink in the ejection ports 14*a*, and the term "non-ejection flushing" means that the actuator units 17 are driven to vibrate meniscuses formed in the ejection ports 14*a* so as not to eject ink droplets from the ejection ports 14*a*). Furthermore, the detection electrodes 19*b* are electrically connected to the individual electrodes 19*a* that are used in recording and/or flushing. Accordingly, there is no need to separately provide a member for forming the detection electrodes 19*b*, whereby the configuration of the actuator units 17 may be simplified.

The individual electrodes 19*a* are larger than the openings of the pressure chambers 16. Thus, even when the piezoelectric layer 17*a* or the piezoelectric layer 17*b* that has the individual electrodes 19*a* (sandwich the individual electrodes 19*a*) contracts due to firing, the openings and the individual electrodes 19*a* may be precisely and easily aligned. This increases the deformation efficiency of the inner active portions 19*x*, at portions that oppose the individual electrodes 19*a*, making it possible to assuredly perform operations related to recording and flushing.

Each actuator unit 17 includes the diaphragm 17*c* disposed between the flow path unit 12 and the piezoelectric layers 17*a* and 17*b* so as to seal the openings of the pressure chambers 16. Thus, it is possible to realize unimorph deformation, bimorph deformation, and multimorph deformations using the diaphragm 17*c*. Furthermore, by disposing the diaphragm 17*c* between the flow path unit 12 and the piezoelectric layers 17*a* and 17*b*, it is possible to prevent an electrical failure, such as a short-circuit caused by an ink component in the pressure chambers 16 moving during driving of the piezoelectric layers 17*a* and 17*b*.

In the actuator units 17, the common electrode 20 disposed most adjacent to the top surface 12*x* of the flow path unit 12 is the ground electrode. When the common electrode 20 is not electrically grounded, a potential difference occurs between the electrode 20 and the ink in the openings of the pressure chambers 16, which may cause a short-circuit due to the movement of the ink component in the openings. However, such a problem may be avoided with this embodiment.

The common electrode 20 extends over the entire surfaces of the piezoelectric layer 17*b* and the diaphragm 17*c*. Thus, an electrical failure due to a leakage electric field (for example, an electrical short-circuit due to the electroosmosis of the ink component in the openings of the pressure chambers 16) may be prevented.

The piezoelectric layers 17*a* and 17*b* are polarized in the same direction along the thickness direction. When the piezoelectric layers 17*a* and 17*b* are polarized in the opposite directions along the thickness direction, a blocking electrode needs to be added to the common electrode 20 to cause the piezoelectric layers 17*a* and 17*b* to be displaced in the same direction. The blocking electrode is a grounded electrode such as the common electrode 20, and it prevents an electric field, generated by the inner electrode 19 or the independent electrodes 18 that sandwich the piezoelectric layers 17*a* and 17*b* relative to the common electrode 20, from acting on the ink. In this case, the added blocking electrode functions as a rigid body and inhibits the deformation of the active portions

18*x* and 19*x*. In contrast, according to this embodiment, only the common electrode 20 is made to function as the ground electrode, whereby degradation of the deformation efficiency of the active portions 18*x* and 19*x* may be prevented.

Each detection electrode 19*b* includes the first and second outer peripheral portions 19*b*1 and 19*b*2, and the central portion 19*b*3 that electrically connects the ends of the first and second outer peripheral portions 19*b*1 and 19*b*2. This simplifies the configuration of the detection electrodes 19*b* and enables more precise detection of a crack generated in the areas that oppose the lands of the piezoelectric layers 17*a* and 17*b*.

The lands 18*c* are disposed at the ends of the extraction electrodes 18*b* in the extraction direction. In this case, when the actuator units 17 are mounted on the flow path unit 12, the lands 18*c* may be disposed so as not to oppose the pressure chambers 16. Accordingly, generation of cracks in the piezoelectric layers 17*a* and 17*b* due to the force applied to the lands 18*c* may be prevented.

By providing the auxiliary electrodes 19*d*, the following advantages may be obtained: even if a crack that cuts the extension electrode 19*c* (for example, a crack C2 shown in FIG. 7) is generated in the process of mounting the actuator units 17 to the flow path unit 12, the process of bonding the FPCs 50 to the actuator units 17 (the process of bonding the terminals of the FPCs 50 and the lands 18*c*), or the like, it is possible to continue detection of cracks in the areas that oppose the lands 18*c* by the detection electrodes 19*b*, by supplying signals through the auxiliary electrodes 19*d*. For example, when the outer peripheral portions 19*b*1 and 19*b*2 of the detection electrodes 19*b* are electrically connected to the individual electrodes 19*a* only through the extension electrodes 19*c*, and if a crack is generated in the piezoelectric layer 17*a* or the piezoelectric layer 17*b*, in the areas that oppose the extension electrodes 19*c*, the extension electrode 19*c* is cut and a current-flow error occurs even though the crack is not generated in the areas that oppose the lands 18*c*. However, in this embodiment, the provision of the auxiliary electrodes 19*d* allows a current to flow even when a crack is generated in the piezoelectric layer 17*a* or the piezoelectric layer 17*b*, in the areas that oppose the extension electrodes 19*c*. That is, it is possible to more precisely detect a crack in the areas that oppose the lands 18*c* by preventing a current-flow error caused by a crack generated in the area that does not oppose the lands 18*c*.

Because the crack C1 generated in the area that opposes the land 18*c*, among the cracks C1, C2, and C3 shown in FIG. 7, is likely to cause migration, it needs to be detected, and proper treatment, such as repair or disposal of the actuator unit 17, needs to be performed. Because the crack C2 generated in the area that opposes the extension electrode 19*c* and the crack C3 generated in the area that opposes the individual electrode 19*a* or the surface electrode 18*a* are less likely to cause migration, such cracks do not need to be detected.

Next, another embodiment of the piezoelectric actuator will be described.

All the detection electrodes 19*b* included in the inner electrode 19 are electrically connected in series in the above-described embodiment, whereas the detection electrodes 19*b* included in the inner electrode 19 are electrically connected in series by line or column in another embodiment. Because the configurations other than this are the same as the above-described embodiment, descriptions thereof will be omitted.

In this embodiment, similarly to the above-described embodiment, the detection electrodes 19*b* are arranged in a matrix form so as to form a plurality of lines and columns corresponding to the arrangement of the lands 18*c*, as shown in FIG. 6C. Herein, assuming that the sub-scanning direction is the line direction, a plurality of detection electrodes 19*b* arranged in the line direction may be considered as one group. In this embodiment, one line is considered as one group, and the detection electrodes 19*b* in each line are electrically connected. Alternatively, assuming that the main scanning direction is the line direction, and the sub-scanning direction is the column direction, one column is considered as one group, and the detection electrodes 19*b* in each column are electrically connected.

As has been described above, in the actuator unit according to this embodiment, by electrically connecting the detection electrodes 19*b* by line or column, it is possible to simplify the wire structure and signal-supplying structure with respect to the detection electrodes 19*b*, to enable efficient crack detection over a large area, and to specify a portion where a crack exists by group (line or column).

In addition, during driving of the head 10, meniscus vibration may be generated by group. Thus, it is possible to reduce the power load during driving and to reduce cross talk corresponding to the inner structure.

Although the embodiments of the present invention has been described above, the present invention is not limited to the above-described embodiment, and the design thereof may be variously modified within a scope described in the claims.

The arrangement and shape of the piezoelectric layers and the electrodes included in the actuators, as well as the modification of the actuators, are not limited to those of the above-described embodiments and may be variously modified.

For example, in the actuator units 17, another component (another electrode, another piezoelectric layer, or the like) may be disposed between the piezoelectric layer 17*a* and the piezoelectric layer 17*b* and/or between the piezoelectric layer 17*b* and the diaphragm 17*c*. Furthermore, the diaphragm 17*c* may be omitted.

The surface electrodes 18*a* do not necessarily have to be analogous with and smaller than the openings of the pressure chambers 16 as viewed in the thickness direction of the piezoelectric layers 17*a* and 17*b*, but may have any shape and size.

Although the individual electrodes 19*a* are analogous with the openings of the pressure chambers 16 as viewed in the thickness direction of the piezoelectric layers 17*a* and 17*b*, they are not limited thereto. For example, even if the individual electrodes 19*a* are not analogous with the openings of the pressure chambers 16, as long as the individual electrodes 19*a* are larger than the openings, the individual electrodes 19*a* may be precisely and easily aligned with the openings when the piezoelectric layer 17*a* or the piezoelectric layer 17*b* having the inner electrode 19 contract due to firing. Furthermore, the individual electrodes 19*a* do not have to be larger than the openings of the pressure chambers 16.

The inner electrode 19 including the detection electrodes 19*b*, the individual electrodes 19*a*, etc., does not have to be disposed on the bottom surface of the piezoelectric layer 17*a* (between the piezoelectric layers 17*a* and 17*b*) and may be disposed on the bottom surface of the piezoelectric layer 17*b* (between the piezoelectric layer 17*b* and the diaphragm 17*c*).

The individual electrode 19*a* and the detection electrode 19*b* corresponding to one independent electrode 18 do not have to be electrically connected.

The individual electrodes 19*a* may be omitted. In such a case, for example, linear electrodes, such as the extension electrodes 19*c*, may be disposed at portions where the individual electrodes 19*a* are disposed in FIG. 6C.

The electrode disposed most adjacent to the top surface 12*x* of the flow path unit 12 (in the above-described embodiment, the common electrode 20) does not have to extend over the entire surface where the electrode is disposed (in the above-described embodiment, the surfaces of the piezoelectric layer 17*b* and diaphragm 17*c*) but may extend over portion of the surface. Furthermore, the electrode does not have to be grounded.

As long as the detection electrode is continuous, it does not necessarily have to have a substantially Z shape as in the above-described embodiment, and it may be variously modified. The detection electrode may have, for example, an Ω (orm) shape that has no central portion 19*c* and has only an outer peripheral portion extending along the outline of an area that opposes the lands so as to encircle the area.

The auxiliary electrodes 19*d* do not have to have an L shape but may have a curved shape.

The auxiliary electrodes 19*d* may be omitted. For example, in one modification, the auxiliary electrodes 19*d* of the inner electrode 19 are omitted, and the outer peripheral portions 19*b*1 and 19*b*2 of the detection electrodes 19*b* are electrically connected to the individual electrodes 19*a* only through the extension electrodes 19*c*. Furthermore, one of the auxiliary electrodes 19*d*1 and 19*d*2 may be omitted.

In the above-described embodiment, the thickness of the piezoelectric layer 17*a* is larger than the total thickness of the piezoelectric layer 17*b* and the diaphragm 17*c*. By making the thickness of the piezoelectric layer 17*a* relatively large, the deformation efficiency of the piezoelectric layer 17*a* can be improved. However, the thickness is not limited thereto, and the thickness of the piezoelectric layers included in the actuator may be appropriately modified. For example, the total thickness of the piezoelectric layer 17*a* and the piezoelectric layer 17*b* may be the same as the thickness of the diaphragm 17*c* or larger than the thickness of the diaphragm 17*c*.

The piezoelectric layers 17*a* and 17*b* may be polarized in the opposite directions along the thickness direction.

The position and shape of the lands 18*c* are not specifically limited. For example, it is possible to omit the extraction electrode 18*b* and dispose the lands 18*c* on the surface electrodes 18*a*, i.e., at positions opposite the openings of the pressure chambers 16. The shape of the lands 18*c* is not limited to circular, but may be any shape, such as square, rectangular, or oval.

In the above-described another embodiment, not one line or column, but two or more lines or columns of the detection electrodes 19*b* may be considered as one group and electrically connected.

The plurality of detection electrodes 19*b* do not have to be electrically connected. In such a case, by installing wires and supplying signals for each detection electrode 19*b* and by checking a current flow for each detection electrode 19*b*, cracks may be detected.

The actuators do not have to perform unimorph deformation, but may perform monomorph deformation, bimorph deformation, or multimorph deformation.

The number of piezoelectric layers included in each piezoelectric actuator of the present invention may be one (the first piezoelectric layer). For example, the individual electrodes 19*a* may be omitted, together with the second active portions 19*x*.

The piezoelectric actuators of the present invention do not have to have members that sandwich the detection electrodes relative to the first piezoelectric layer from the flow-path forming member side. In other words, the detection electrodes may be exposed to the pressure chambers.

The first piezoelectric layer and/or the second piezoelectric layer included in the piezoelectric actuator of the present invention do not have to be provided over the openings of the plurality of pressure chambers, but may be provided for each opening.

The present invention may be applied to either line-type liquid-droplet ejection heads or serial-type liquid-droplet ejection heads. Furthermore, the present invention may be applied not only to printers, but also to facsimiles, copiers, etc. In addition, the liquid-droplet ejection head of the present invention may eject droplets other than ink droplets.

What is claimed is:

1. A piezoelectric actuator disposed on a surface of a flow-path forming member of a liquid-droplet ejection head, the piezoelectric actuator applying energy to liquid in pressure chambers that are opened in the surface, the piezoelectric actuator comprising:

a first piezoelectric layer disposed farthest from the surface of the flow-path forming member among one or more piezoelectric layers included in the piezoelectric actuator, the first piezoelectric layer having a first active portion that is displaced by an electric field acting in a thickness direction;

a surface electrode configured to apply an electric field to the first active portion, the surface electrode being disposed on one surface of the first piezoelectric layer opposite the surface of the flow-path forming member;

a land bonded to a terminal of a power supply member configured to supply a signal to the surface electrode, the land being disposed so as to be electrically connected to the surface electrode on the one surface of the first piezoelectric layer; and a continuous detection electrode including an outer peripheral portion extending along the outline of an area that opposes the land so as to surround the area, the detection electrode being disposed on one of the other surface of the first piezoelectric layer and a surface of a second piezoelectric layer underlying the first piezoelectric layer.

2. The piezoelectric actuator according to claim 1, wherein the detection electrode is disposed on the other surface of the first piezoelectric layer.

3. The piezoelectric actuator according to claim 2, further comprising a member that sandwiches the detection electrode relative to the first piezoelectric layer from the flow-path forming member side.

4. The piezoelectric actuator according to claim 1, wherein the first piezoelectric layer is disposed over a plurality of the openings, wherein a plurality of the surface electrodes that oppose the openings and a plurality of the lands electrically connected to the surface electrodes are disposed on the one surface of the first piezoelectric layer, and wherein a plurality of the detection electrodes are electrically connected to the plurality of corresponding lands.

5. The piezoelectric actuator according to claim 4, wherein all the detection electrodes are electrically connected to all the corresponding lands disposed on the one surface of the first piezoelectric layer.

6. The piezoelectric actuator according to claim 4, wherein the plurality of lands are arranged in a matrix form so as to form a plurality of lines and columns on the one surface of the first piezoelectric layer, and wherein the plurality of detection electrodes form a plurality of groups arranged in a line direction or a column direction, and the detection electrodes in each group are electrically connected.

7. The piezoelectric actuator according to claim 1, wherein the second piezoelectric layer includes a second active portion that opposes the first active portion, wherein the piezoelectric actuator further comprises an individual electrode that is disposed on the surface of the second piezoelectric layer and configured to apply an electric field to the second active portion, and wherein the individual electrode is electrically connected to the detection electrode.

8. The piezoelectric actuator according to claim 7, wherein the individual electrode is larger than the opening.

9. The piezoelectric actuator according to claim 1, further comprising a diaphragm disposed between the piezoelectric layer and the flow-path forming member so as to seal the opening.

10. The piezoelectric actuator according to claim 1, wherein the electrode disposed most adjacent to the surface of the flow-path forming member is a ground electrode.

11. The piezoelectric actuator according to claim 10, wherein the ground electrode extends over the entirety of the surface where the ground electrode is disposed.

12. The piezoelectric actuator according to claim 10, wherein two or more piezoelectric layers are polarized in the same direction along the thickness direction.

13. The piezoelectric actuator according to claim 1, wherein the outer peripheral portion includes a first outer peripheral portion and a second outer peripheral portion each extending along the half of the outline, and wherein the detection electrode includes the first and second outer peripheral portions and a central portion that passes through the center of the area and electrically connects ends of the first and second outer peripheral portions to each other.

14. The piezoelectric actuator according to claim 1, wherein the land is disposed at an end of an extraction electrode extracted from the surface electrode in an extraction direction.

15. The piezoelectric actuator according to claim 1, further comprising:

an extension electrode that extends from an end of the outer peripheral portion of the detection electrode to the outer side of the area; and an auxiliary electrode that electrically connects an outer electrode electrically connected to an end of the extension electrode in an extension direction and the end of the outer peripheral portion.

16. A liquid-droplet ejection head comprising:

a flow-path forming member including an ejection surface in which ejection ports for ejecting droplets are opened and a surface in which pressure chambers connected to the ejection ports are opened; and a piezoelectric actuator disposed on the surface of the flow-path forming member and configured to apply energy to liquid in the pressure chambers, wherein the piezoelectric actuator comprises:

a first piezoelectric layer disposed farthest from the surface of the flow-path forming member among one or more piezoelectric layers included in the piezoelectric actuator, the first piezoelectric layer having a first active portion that is displaced by an electric field acting in a thickness direction;

a surface electrode configured to apply an electric field to the first active portion, the surface electrode being disposed on one surface of the first piezoelectric layer opposite the surface of the flow-path forming member;

a land bonded to a terminal of a power supply member configured to supply a signal to the surface electrode, the land being disposed so as to be electrically connected to the surface electrode on the one surface of the first piezoelectric layer; and a continuous detection electrode including an outer peripheral portion extending along the outline of an area that opposes the land so as to surround the area, the detection electrode being disposed on one of the other surface of the first piezoelectric layer and a surface of a second piezoelectric layer underlying the first piezoelectric layer.

* * * * *